US008508414B2

(12) United States Patent
Cho

(10) Patent No.: US 8,508,414 B2
(45) Date of Patent: Aug. 13, 2013

(54) ELECTRICAL SIGNAL CONNECTING UNIT, ANTENNA DEVICE AND MOBILE COMMUNICATION DEVICE HAVING THE SAME

(75) Inventor: Young-Wan Cho, Suwon-si (KR)

(73) Assignee: Samsung Electronics Co., Ltd., Suwon-si (KP)

( * ) Notice: Subject to any disclaimer, the term of this patent is extended or adjusted under 35 U.S.C. 154(b) by 1179 days.

(21) Appl. No.: 12/231,098

(22) Filed: Aug. 29, 2008

(65) Prior Publication Data

US 2009/0058740 A1 Mar. 5, 2009

(30) Foreign Application Priority Data

Aug. 31, 2007 (KR) ..... 10-2007-0088391

(51) Int. Cl.
*H01Q 1/24* (2006.01)
*H01Q 1/36* (2006.01)

(52) U.S. Cl.
USPC ..... 343/702; 343/895; 343/906; 343/700 MS

(58) Field of Classification Search
None
See application file for complete search history.

(56) References Cited

U.S. PATENT DOCUMENTS

| | | | | |
|---|---|---|---|---|
| 6,075,500 | A | 6/2000 | Kurz et al. | |
| 6,844,804 | B2 * | 1/2005 | Gijs | 336/200 |
| 6,900,768 | B2 * | 5/2005 | Iguchi et al. | 343/702 |
| 7,126,547 | B2 * | 10/2006 | Kim et al. | 343/702 |
| 7,339,533 | B2 * | 3/2008 | Kurashima et al. | 343/702 |
| 2003/0020658 | A1 * | 1/2003 | Apostolos | 343/700 MS |
| 2007/0035454 | A1 * | 2/2007 | Zarnowitz et al. | 343/702 |
| 2008/0001830 | A1 * | 1/2008 | Hirai et al. | 343/702 |
| 2008/0122705 | A1 | 5/2008 | Kurashima et al. | |

FOREIGN PATENT DOCUMENTS

| | | | |
|---|---|---|---|
| CN | 1862877 | A | 11/2006 |
| CN | 1478313 | | 12/2006 |
| CN | 101023654 | | 8/2007 |
| EP | 2006033583 | | 2/2006 |
| JP | 11-220319 | * | 8/1999 |
| JP | 11220319 | | 8/1999 |
| JP | 2006033583 | | 2/2006 |
| KR | 1020060038255 | A | 5/2006 |
| WO | WO 03/028149 | A1 | 4/2003 |
| WO | WO 03/050915 | A1 | 6/2003 |
| WO | WO 2006/011572 | A1 | 2/2006 |

OTHER PUBLICATIONS

European Search Report dated Jan. 16, 2009 in connection with European Patent Application No. EP 08 16 2605, 7 pages.
Office Action dated Jun. 27, 2011 in connection with Chinese Patent Application No. 200810212510.X. 11 pages.
Office Action dated Feb. 5, 2010 in connection with Chinese Patent Application No. 200810212510.X. 7 pages.

* cited by examiner

*Primary Examiner* — Trinh Dinh

(57) ABSTRACT

An electrical signal connecting unit includes a predetermined length of a soft connector body; a path pattern formed along one path on the connector body, with a plurality of pattern portions thereof extending in different path directions; and an antenna disposed on the path pattern, opposite ends of the antenna protruding through opposite ends of the connector body. A length of antenna is easily disposed inside a mobile communication device having the electrical signal connecting unit and an antenna device even if the mobile communication device has a plurality of boards.

20 Claims, 6 Drawing Sheets

ELECTRICAL SIGNAL CONNECTING UNIT, ANTENNA DEVICE AND MOBILE COMMUNICATION DEVICE HAVING THE SAME

CROSS-REFERENCE TO RELATED APPLICATION(S) AND CLAIM OF PRIORITY

This application makes reference to and claims all benefits accruing under 35 U.S.C. §119 from an application for "ELECTRICAL SIGNAL CONNECTING UNIT, ANTENNA DEVICE AND MOBILE COMMUNICATION DEVICE HAVING THE SAME" earlier filed in the Korean Intellectual Property Office on Aug. 31, 2007, and there duly assigned Serial No. 10-2007-0088391.

TECHNICAL FIELD OF THE INVENTION

The present invention relates to a mobile communication device and, more particularly, to an electrical signal connecting unit and an antenna device, by which a length of antenna can be easily disposed inside a mobile communication device having a plurality of boards, and a mobile communication device having the same.

BACKGROUND OF THE INVENTION

Typically, mobile communication devices are electronic devices that can exchange, via wireless communication, voice and video information with a counterpart.

Through the distribution of the mobile communication devices, users can exchange information regardless of location.

The size of the mobile communication devices is also decreasing, so that the users can carry them more easily.

Recently, functions of the mobile communication device are not limited to the exchange of voice and video information, but also include other functions, such as user convenient function and entertainment function, which are newly added.

A user can enjoy various functions, such as watching a movie, listening to music, and communicating with a counterpart, using one mobile communication device. The user can also receive information using a receiver, and perform a voice communication if necessary. Thus, the time that a user carries and uses the mobile communication device is gradually increasing.

Among these functions, the function of receiving a frequency modulation (FM) radio broadcast is carried out by a receiver circuit of an FM radio receiver, which is mounted inside the mobile communication device.

The FM radio receiver circuit is highly integrated to such a degree that it can be realized with a single chip and some passive devices.

An antenna is required to be long enough to raise reception efficiency. This, however, makes it difficult to dispose the antenna inside the mobile communication device.

Conventionally, in order to overcome such a problem, the antenna having a required length is stacked on a portion of an internal board of the mobile communication device, or is disposed inside an earphone line or a speaker line, which is separately provided. Otherwise, an active antenna is used.

However, an antenna with a size of 1 mm or more cannot be disposed on the board of the mobile communication device, which is gradually reducing in size.

In the case where the earphone line or the speaker line is used, FM reception efficiency becomes terribly poor when the earphone or speaker line is detached from the mobile communication device.

While the active antenna can reduce the length of the antenna to a predetermined value, a separate electronic circuit having an active rod transistor is required to be disposed on the board, thereby increasing the manufacturing cost of the mobile communication device.

SUMMARY OF THE INVENTION

To address the above-discussed deficiencies of the prior art, it is a primary object to provide an electrical signal connecting unit, an antenna device and a mobile communication device having the same, in which a predetermined length of antenna used for receiving FM radio signals is disposed, with a multiple structure, in a predetermined area in order to minimize the construction area of the antenna.

The invention is also directed to provide an electrical signal connecting unit, an antenna device and a mobile communication device having the same, in which a predetermined length of antenna used for receiving FM radio signals is disposed, with a multiple structure, in a predetermined area of printed circuit boards (PCBs), on which electronic components are mounted, and connector units, which electrically connect the PCBs to each other.

The invention is also directed to provide an electrical signal connecting unit, an antenna device and a mobile communication device having the same, in which a predetermined length of antenna used for receiving FM radio signals is easily disposed, with a multiple structure, inside the mobile communication device, so that excellent sensitivity of receiving FM signals can be obtained without the use of a separate external antenna unit.

According to an aspect of the invention, the electrical signal connecting unit includes a predetermined length of soft connector body; a path pattern formed along one path on the connector body, with a plurality of pattern portions thereof extending in different path directions; and an antenna disposed on the path pattern, opposite ends of the antenna protruding through opposite ends of the connector body.

The path pattern may be formed in the longitudinal direction of the connector body.

The path pattern may be formed across the longitudinal direction of the connector body.

The path pattern may be wound on outer circumferential portions of the connector body along the longitudinal direction of the connector body.

According to another aspect of the invention, the antenna device includes a plurality of boards made of a rigid material, each of the boards having a connector; at least one connector body having a predetermined length, the connector bodies made of a soft material and connecting the boards; a main path pattern formed along one path on the connector body, with pattern portions thereof extending in different path directions; and an antenna disposed on the main path pattern, and connected, at opposite ends thereof, to the connectors, respectively, the opposite ends of the antenna elements protruding opposite ends of the connector body.

The main path pattern may be formed in the longitudinal direction of the connector body.

The main path pattern may be formed across the longitudinal direction of the connector body.

The main path pattern may be wound on outer circumferential portions of the connector body along the longitudinal direction of the connector body.

Each of the boards may have a sub-path pattern, which connects the connector to the main path pattern, and on which a portion of the antenna protruding from the connector body is disposed.

Here, the sub-path pattern may be formed along one path, with pattern portions of the sub-path pattern extending in different path directions.

One of the boards has a receiver, which receives voice information, and an antenna output terminal electrically connected to the receiver.

Here, the antenna output terminal may have a predetermined length of signal line, which sends out the voice information.

In addition, a predetermined length of antenna may be provided inside the signal line.

Furthermore, a predetermined length of bar antenna composed of slidable overlapping sections may be disposed on the connector.

One of the boards may have multiple layers of board bodies.

Here, each of the board bodies may have an antenna pattern, which is shaped to extend the antenna disposed on the sub-path pattern.

According to a further aspect of the invention, the mobile communication device includes a main body, on which a first board made of a rigid material is disposed; a sub-body, on which a second board made of a soft material is disposed, the sub-body slidably coupled to the main body; a predetermined length of connector body made of a soft material, and connecting the first and second boards to each other; a main path pattern formed along one path on the connector body, with pattern portions thereof extending in different path directions; and an antenna disposed on the main path pattern, and connected, at opposite ends thereof, to the connectors, respectively, the opposite ends of the antenna elements protruding opposite ends of the connector body.

The main path pattern may be formed in the longitudinal direction of the connector body.

The main path pattern may be formed across the longitudinal direction of the connector body.

The main path pattern may be wound on outer circumferential portions of the connector body along the longitudinal direction of the connector body.

Each of the boards may have a sub-path pattern, which connects the connector to the main path pattern, and on which a portion of the antenna protruding from the connector boy is disposed.

Here, the sub-path pattern may be formed along one path, with pattern portions of the sub-path pattern extending in different path directions.

One of the boards has a receiver, which receives voice information, and an antenna output terminal electrically connected to the receiver.

Here, the antenna output terminal may have a predetermined length of signal line, which sends out the voice information.

Furthermore, a predetermined length of antenna may be provided inside the signal line.

The second board may have multiple layers of board bodies.

Here, each of the board bodies may have an antenna pattern, which extends the antenna disposed on the sub-path pattern.

According to the invention as set forth above, a predetermined length of antenna used for receiving FM radio signals is disposed, with a multiple structure, in a predetermined area in order to minimize the construction area of the antenna.

Furthermore, a predetermined length of antenna used for receiving FM radio signals is disposed, with a multiple structure, in a predetermined area of PCBs, on which electronic components are mounted, and connector units, which electrically connect the PCBs.

Moreover, a predetermined length of antenna used for receiving FM radio signals is easily disposed, with a multiple structure, inside the mobile communication device, so that excellent sensitivity of receiving FM signals can be obtained without the use of a separate external antenna unit.

Before undertaking the DETAILED DESCRIPTION OF THE INVENTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION OF THE INVENTION

FIGS. 1 through 9, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged mobile communication and antenna device.

Hereinafter, the following description will be made of an electrical signal connecting unit, an antenna device and a mobile communication device having the same of the present invention with reference to the accompanying drawings.

Figure 1:
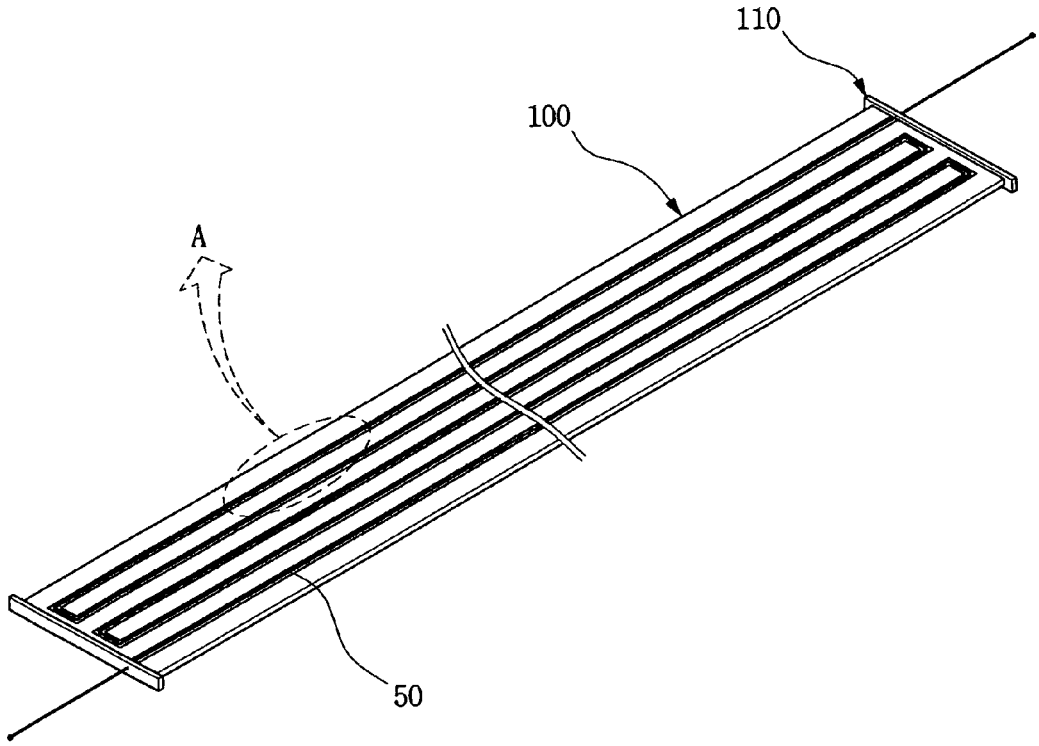
FIG. 1 is a perspective view illustrating a first embodiment of an electrical signal connecting unit of the present invention.
Figure 2:
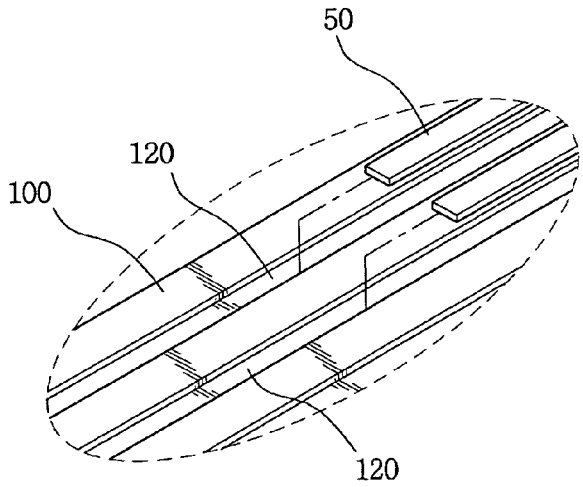
FIG. 2 is an enlarged perspective view of the part A of FIG. 1.
Figure 3:
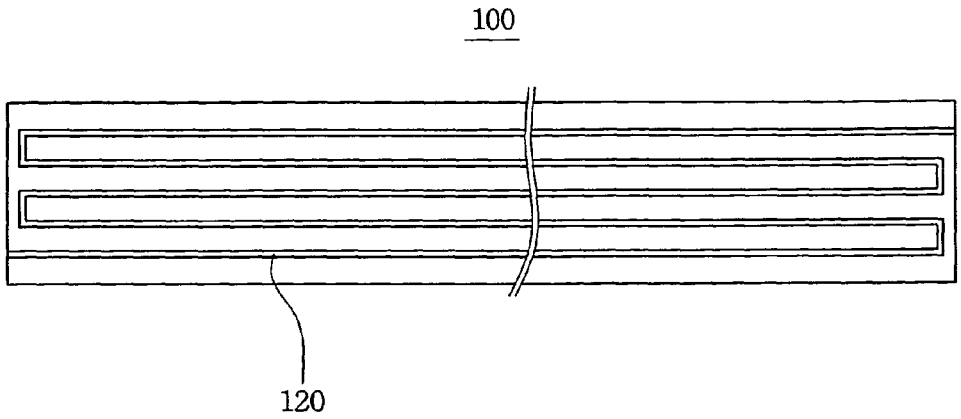
FIG. 3 is a plan view illustrating the first embodiment of the electrical signal connecting unit of the present invention.
Figure 4:
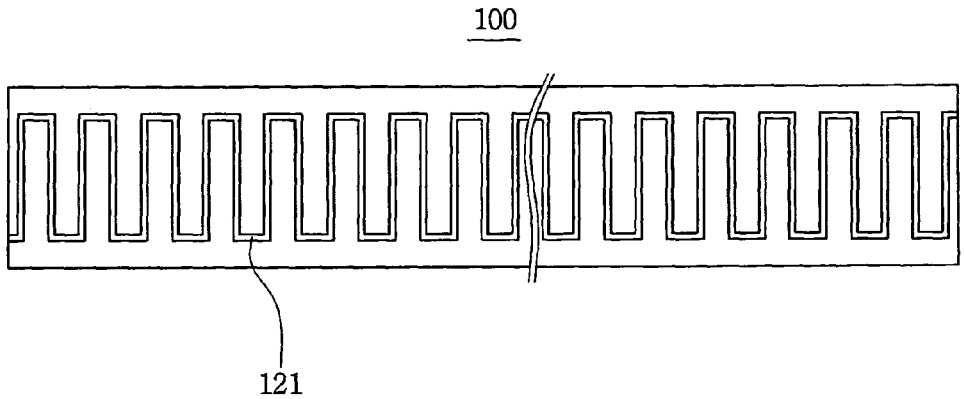
FIG. 4 is a plan view illustrating a second embodiment of the electrical signal connecting unit of the present invention.
Figure 5:
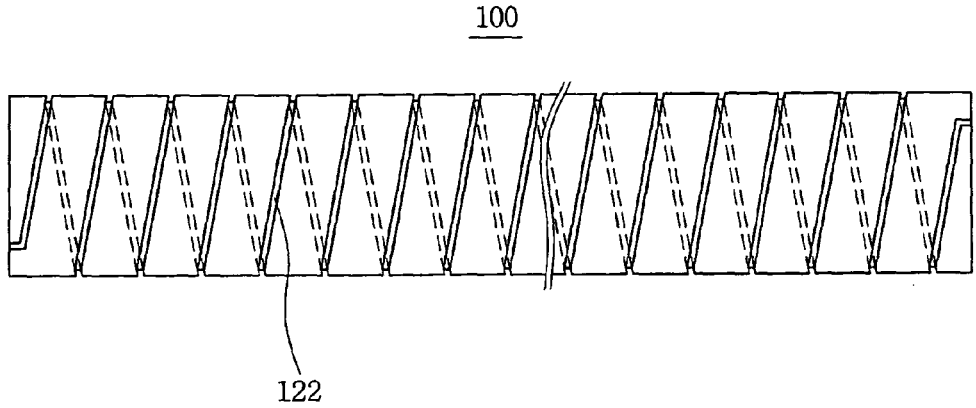
FIG. 5 is a plan view illustrating a third embodiment of the electrical signal connecting unit of the present invention.

FIG. 1 is a perspective view illustrating a first embodiment of the electrical signal connecting unit of the present invention, FIG. 2 is an enlarged perspective view of the part A of FIG. 1, FIG. 3 is a plan view illustrating the first embodiment of the electrical signal connecting unit of the present invention, FIG. 4 is a plan view illustrating a second embodiment of the electrical signal connecting unit of the present invention, and FIG. 5 is a plan view illustrating a third embodiment of the electrical signal connecting unit of the present invention.

Referring to FIGS. 1 to 3, the first embodiment of the electrical signal connecting unit of the present invention includes a connector body 100, a path pattern 120 formed on the body 100 and an antenna 50 disposed on the path pattern 120.

The connector body 100 has predetermined dimensions such as width and length, and connectors 110 are provided at opposite ends of the connector body 100.

The connector body 100 is made of a soft material. For example, the connector body 100 may be implemented as a flexible printed circuit board (FPCB).

Although not shown in the drawings, the connector body 100 is provided with electric signal lines, which electrically connect the connectors 110, at the opposite ends of the connector body 100, to each other.

The path pattern 120 is formed along one path, and has a plurality of pattern portions extending in different directions.

In the path pattern 120 formed along one path, the pattern portions have a zigzag shape, and are spaced apart from each other at a predetermined interval.

Specifically, as shown in FIG. 1, the path pattern 120 is formed along the length of the connector body 100.

It is preferable that the path pattern 120 be formed on one side of the connector body 100.

The path pattern 120 may also be formed on both sides of the connector body 100.

The antenna 50 is used for receiving FM radio signals, and may have a length of about 75 cm from one end to the other.

Of course, the length of the antenna 50 may be determined to be longer or shorter than 75 cm within a predetermined error range.

The antenna 50 is disposed on the path pattern 120, particularly, via an adhering means (not shown) such as an adhesive.

Here, opposite ends of the antenna 50 protrude through opposite ends of the connector body 100 to a predetermined length.

The antenna 50 in the length of 75 cm, disposed on the path pattern 120, can be provided in a predetermined area of the connector body 100.

FIG. 4 shows a second embodiment of the electrical signal connecting unit of the present invention.

Referring to FIG. 4, the second embodiment of the electrical signal connecting unit includes a connector body 100, path pattern 121 and an antenna 50.

The connector body 100 may have the same construction as that of the first embodiment.

The path pattern 121 has pattern portions, which extend across the longitudinal direction of the connector body 100.

The pattern portions of the path pattern 121 are arrayed on the connector body 100, in a zigzag shape starting from one end to the other end of the connector body 100, and are spaced apart from each other.

The path pattern 121 may be formed on one side or both sides of the connector body 100.

The antenna 50 has a predetermined length of 75 cm, and may be disposed on the path pattern 121.

The antenna 50 disposed on the path pattern 121 can be provided in a predetermined area of the connector body 100.

FIG. 5 shows a third embodiment of the electrical signal connecting unit of the present invention.

Referring to FIG. 5, the third embodiment of the electrical signal connecting unit includes a connector body 100, a path pattern 122 and an antenna 50.

The connector body 100 may have the same construction as that of the first or second embodiment.

The path pattern 122 has a plurality of pattern portions that extend across the longitudinal direction of the connector body 100.

The pattern portions of the path pattern 122 may be wound on the outer circumference of the connector body 100, along the longitudinal direction of the connector body 100.

Specifically, the pattern portions of the path pattern 122 are wound on the outer circumference of the connector body 100, in a zigzag shape starting from one end to the other end of the connector body 100, and are spaced apart from each other.

The path pattern 122 is formed on four sides of the connector body 100.

The antenna 50 has a predetermined length of 75 cm, and may be disposed on the path pattern 122.

The antenna 50 disposed on the path pattern 122 can be provided in a predetermined area of the connector body 100.

As illustrated in FIGS. 1 to 5 and described above, the electrical signal connecting unit of the present invention may include any one of the path patterns 120, 121 and 122 according to the first to third embodiments of the present invention.

The path patterns 120, 121 and 122 according to the above-mentioned embodiments are formed in the predetermined area of the connector body 100, along various path directions, so that the antenna 50 having a length of, for example, 75 cm can be easily housed in the area of the connector body 100.

Figure 6:
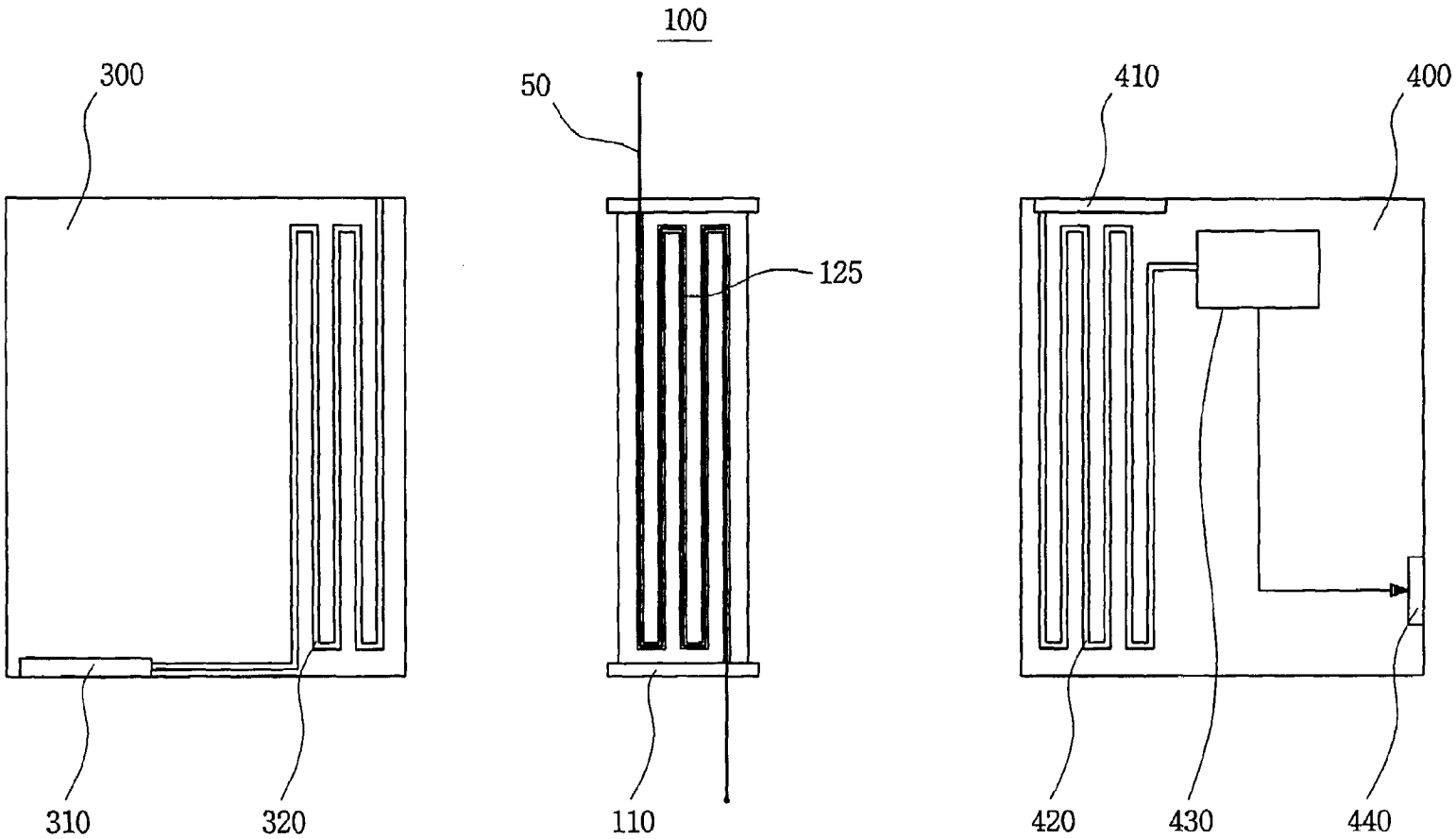
FIG. 6 is a plan view illustrating an antenna device of the present invention.
Figure 7:
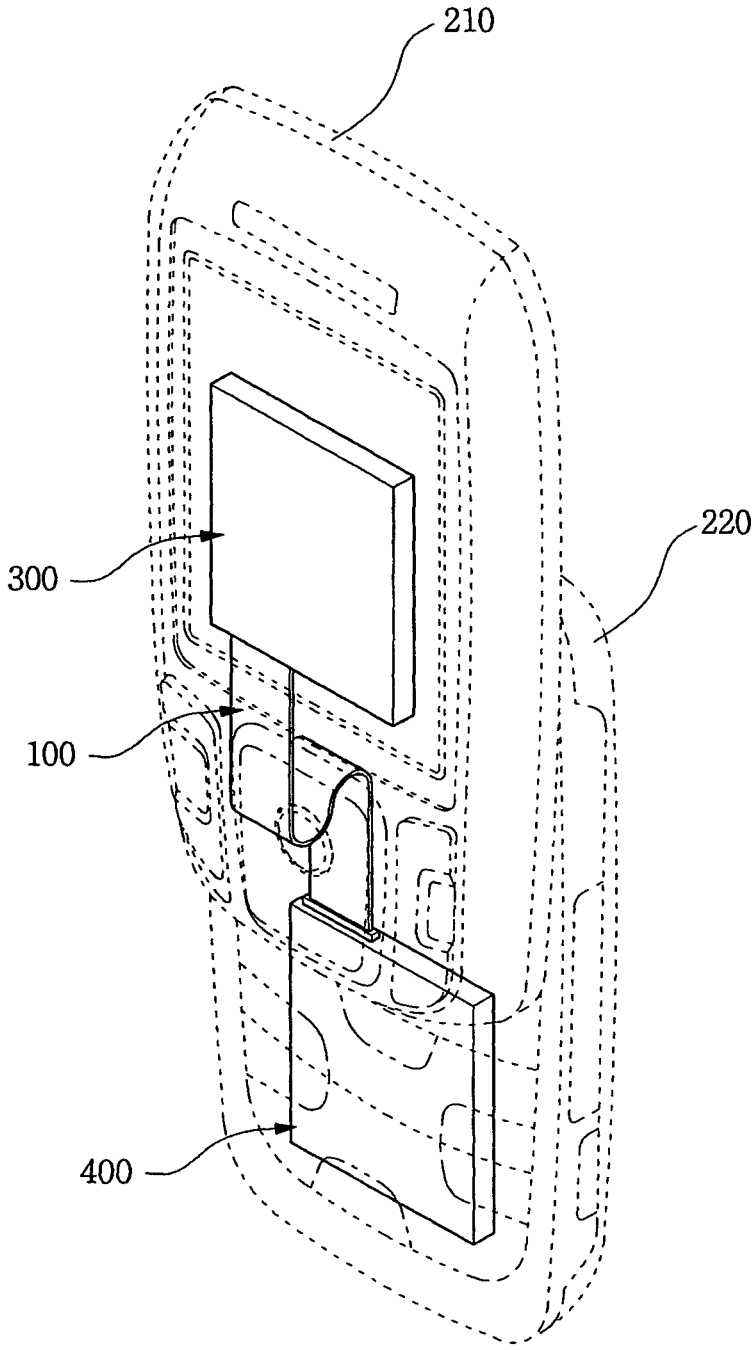
FIG. 7 is a perspective view illustrating a mobile communication device having the antenna device of the present invention.
Figure 8:
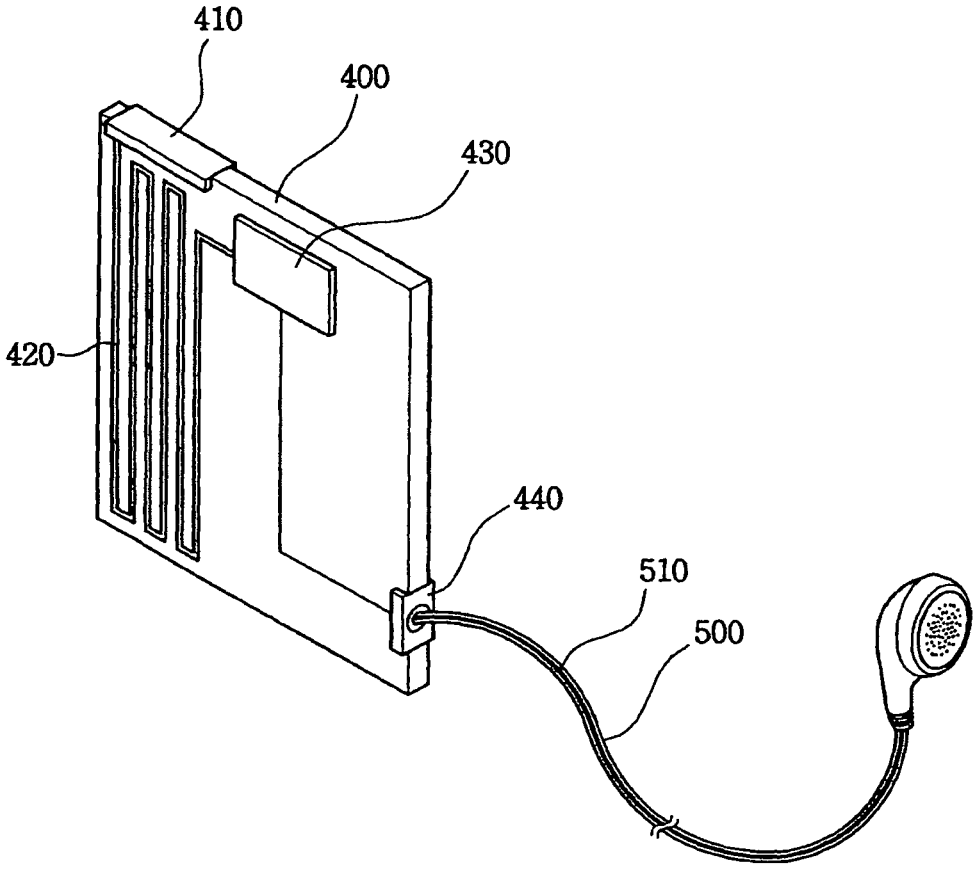
FIG. 8 is a perspective view illustrating the second board of the present invention to which a signal line is further connected.
Figure 9:
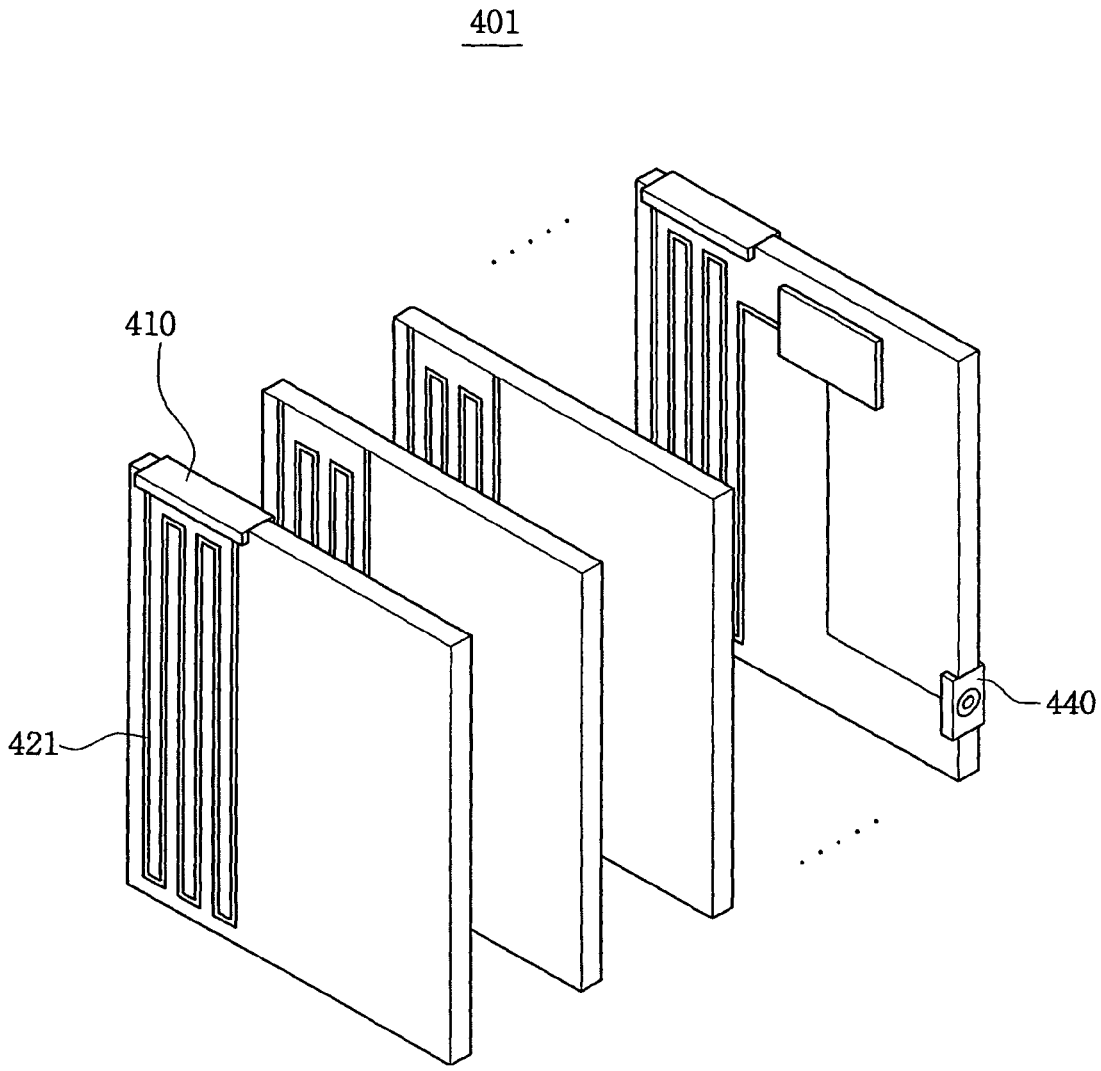
FIG. 9 is a perspective view illustrating the second board of the present invention, which includes a plurality of board bodies.

FIG. 6 is a plan view illustrating an antenna device of the present invention, FIG. 7 is a perspective view illustrating a mobile communication device having the antenna device of the present invention, FIG. 8 is a perspective view illustrating the second board of the present invention, to which a signal line is further connected, and FIG. 9 is a perspective view illustrating the second board of the present invention, which includes a plurality of board bodies.

Now, the antenna device of the present invention will be described with reference to FIG. 6.

The antenna device of the invention includes a plurality of boards 300 and 400, a connector body 100 electrically connecting the boards 300 and 400 and a main path pattern 125 formed on the connector body 100.

The boards 300 and 400 may be provided as a pair.

Each of the boards 300 and 400 is made of a rigid material, and may be implemented as a printed circuit board (PCB) on which electronic components are mounted.

The boards 300 and 400 may be made of a soft material.

Connectors 310 and 410, which can communicate electrical signals with external devices, are provided at one end of the boards 300 and 400.

The connector body 100 may be made of a soft material such as an FPCB.

Alternatively, the connector body 100 may be made of a rigid material.

The connector body 100 is provided, at opposite ends, with connectors 110, each of which is fitted into a corresponding one of connectors 310 and 410 of the boards 300 and 400.

Here, the main path pattern 125 on the connector body 100 may have a plurality of pattern portions of different lengths and widths.

The main path pattern 125 is formed on the connector body 100.

The main path pattern 125 may have the same construction as that of any of the path patterns 120, 121 and 122, which were described above with reference to FIGS. 1 to 5.

The main path pattern 125 may be implemented in the same fashion as those of the first to third embodiments shown in FIGS. 1 to 5.

An antenna element 50 is disposed on the main path pattern 125.

The antenna element 50 has a predetermined length of, for example, 75 cm.

Here, opposite ends of the antenna 50 protrude through opposite ends of the connector body 100 to a predetermined length.

The antenna 50 disposed on the main path pattern 125 can be provided in a predetermined area of the connector body 100.

Accordingly, the main path pattern 125 of the antenna device of the present invention can be provided according to any of the above-mentioned three embodiments.

The main path pattern 125 according to the three embodiments has a plurality of pattern portions, which extend along various path directions in the predetermined area of the connector body 100, so that the antenna 50 having a predetermined length of, for example, 75 cm can be easily housed in the area of the connector body 100.

The board 300 has a sub-path pattern 320 connecting the connector 310 to the main path pattern 125, and the board 400 has a sub-path pattern 420 connecting the connector 410 to the main path pattern 125.

The sub-path pattern 320 of the board 300 can be formed on one path, and have a plurality of pattern portions extending in multiple different path directions. The sub-path pattern 420 of the board 400 can also be formed on one path, and have a plurality of pattern portions extending in multiple different path directions.

Of course, the sub-path patterns 320 and 420 may be formed on only one of the boards 300 and 400.

The sub-path patterns 320 and 420 may have the same construction as that of the path patterns 120, 121 and 122, which were described above with reference to FIGS. 1 to 5.

One of the boards 300 and 400 (for example, the board 400) is provided with a receiver 430 that receives voice information.

The receiver 430 may be implemented as a frequency modulation (FM) radio receiver.

Referring to FIGS. 6 and 8, the board 400 having the receiver 430 is also provided with an antenna output terminal 440, which is electrically connected to the receiver 430.

The antenna output terminal 440 is also electrically connected to a signal line 500.

The signal line 500 is a predetermined length of electric wire that outputs voice signal to an external device. The signal line 500 may be implemented as an earphone line or a speaker line.

In addition, a predetermined length of antenna 510 may be disposed inside the signal line 500.

Thus, the length of the antenna 50 disposed between the main path pattern 125 and the sub-path patterns 320 and 420 can be increased by the length of the antenna 510 inside the signal line 500.

This, as a result, can improve the sensitivity of receiving voice information at the receiver 430.

In addition, although not shown in the drawings, a predetermined length of bar antenna composed of slidable overlapping sections can also be disposed on one of the boards 300 and 400.

Hence, the length of the antenna 50, disposed on the main path pattern 125 and the sub-path patterns 320 and 420, can be further increased by the length of the bar antenna.

As shown in FIG. 9, one of the boards 300 and 400 (for example, the board 400) may include a plurality of board bodies 401, which are placed one above another at a predetermined interval from each other.

In this fashion, the board bodies 401 form a multi-layer structure.

Each of the board bodies 401 may also have an antenna pattern 421, which is shaped to extend the length of the antenna disposed on the sub-path pattern 420.

The length of the antenna pattern 421 can be extended according to the number of the board bodies 401, which are placed one above another, so that the antenna 50 of the invention can be further extended by the length of the main path pattern 125, the length of the sub-path patterns 320 and 420 and the length of the antenna pattern 421, which are added together.

Next, a mobile communication device having an antenna device of the invention will be described with reference to FIG. 7.

The mobile communication device of the invention includes a main body 210 and a sub body 220, which is slidably coupled to the main body 210.

Although not shown in the drawings, the slidable coupling structure may include a sliding groove and a sliding protrusion, which is designed to fit into the sliding groove to slide.

The sliding protrusion may be formed on one of the main body 210 and the sub body 220, along the sliding direction, and the sliding groove may be formed in one of the main body 210 and the sub body 220.

A first board 300, substantially the same as that shown in FIG. 6, is disposed inside the main body 210, and electronic components (not shown) are mounted on the first board 300.

A second board 400 on which electronic components are mounted is disposed inside the sub body 220.

A connector 310 is provided at one end of the first board 300, and a connector 410 is provided at one end of the second board 300.

The first and second boards 300 and 400 may be implemented as a PCB, which is made of a rigid material.

The first and second boards 300 and 400 are electrically connected to each other by the connector body 100.

The connector body 100 may be implemented as an FPCB, which is made of a soft body.

A main path pattern 125 is disposed on the connector body 100, and has a plurality of pattern portions extending along different path directions on one path. An antenna 50 is also disposed on the connector body 100, and is connected, at opposite ends thereof, to the connectors 310 and 410, respectively. The opposite ends of the antenna 50 protrude through opposite ends of the connector body 100.

The construction of the connector body 100 and the main path pattern 125 may be substantially the same as that of the connector body 100, which was described above with reference to FIGS. 1 to 5.

The main path pattern 125 may be implemented in the same fashion as those of the first to third embodiments shown in FIGS. 1 to 5.

The antenna 50 has a predetermined length of, for example, 75 cm.

The antenna 50 is disposed on the main path pattern 125.

Here, the opposite ends of the antenna 50 protrude through the opposite ends of the connector body 100 to a predetermined length.

The antenna 50 disposed on the main path pattern 125 can be disposed in a predetermined area of the connector body 100.

The main path pattern 125 according to the above-mentioned embodiments has a plurality of pattern portions, which are formed along various path directions in the predetermined area of the connector body 100, so that the antenna 50 having a predetermined length of, for example, 75 cm can be easily housed in the area of the connector body 100, where the main path pattern 125 is formed.

The first board 300 also has a sub-path pattern 320 connecting the connector 310 to the main path pattern 125, and the second board 400 also has a sub-path pattern 420 connecting the connector 410 to the main path pattern 125.

Here, the sub-path patterns 320 and 420 may be formed on only one of the boards 300 and 400.

The sub-path patterns 320 and 420 may have the same construction as that of the path patterns 120, 121 and 122, which were described above with reference to FIGS. 1 to 5.

The second board 400 is provided with a receiver 430 that receives voice information. The receiver 430 may be implemented as an FM radio receiver.

As shown in FIG. 8, the board 400 having the receiver 430 is also provided with an antenna output terminal 440, which is electrically connected to the receiver 430.

The antenna output terminal 440 is also electrically connected to a signal line 500.

The signal line 500 is a predetermined length of electric wire that outputs voice signal to an external device. The signal line 500 may be implemented as an earphone line or a speaker line.

In addition, a predetermined length of antenna 510, as shown in FIG. 8, may be disposed inside the signal line 500.

Thus, the length of the antenna 50 disposed on the main path pattern 125 and the sub-path patterns 320 and 420 can be increased by the length of the antenna 510 inside the signal line 500.

This, as a result, can improve the sensitivity of receiving voice information at the receiver 430.

As shown in FIG. 9, one of the boards 300 and 400 (for example the board 400) may include a plurality of board bodies 401, which are placed one above another at a predetermined interval from each other.

In this fashion, the board bodies 401 form a multi-layer structure.

Each of the board bodies 401 may also have an antenna pattern 421, which is shaped to extend the length of the antenna that is disposed on the sub-path pattern 420.

Hence, the length of the antenna pattern 421 can be extended according to the number of the board bodies 401, which are placed one above another.

That is, the antenna 50 of the invention can be further extended by the length of the main path pattern 125, the length of the sub-path patterns 320 and 420 and the length of the antenna pattern 421, which are added together.

In the mobile communication device of the invention, the length of the antenna 50 can be extended by the length of the main path pattern 125, the length of the sub-path patterns 320 and 420 and the length of the antenna pattern 421, so that the antenna 50 can be easily mounted on a predetermined inside area of the mobile communication device.

Furthermore, the mobile communication device of the invention can house the entire length of the antenna 50. In the case where the antenna 50 is required to be longer than the predetermined length, the length of the signal line 500 can be extended or the number of the board bodies 401 of the second board 400 can be increased in order to meet the requirements.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. An electrical signal connecting unit comprising:

a connector body, wherein the connector body is a flexible material;

a path pattern formed along a path on the connector body, the path pattern having a plurality of pattern portions thereof extending in a plurality of different path directions; and an antenna disposed on the path pattern, the antenna having opposite ends protruding through opposite ends of the connector body, the opposite ends of the antenna including a first end connected to a first board and a second end connected to a second board.

2. The electrical signal connecting unit according to claim 1, wherein the path pattern is formed in a longitudinal direction of the connector body.

3. The electrical signal connecting unit according to claim 1, wherein the path pattern is formed across a longitudinal direction of the connector body.

4. The electrical signal connecting unit according to claim 1, wherein the path pattern is wound around an outer circumferential portion of the connector body along a longitudinal direction of the connector body.

5. An antenna device comprising:

a plurality of boards made of a rigid material, each of the plurality of boards having a connector;

a connector body, the connector body made of a flexible material and connecting two boards of the plurality of boards;

a main path pattern formed along a path on the connector body, the main path pattern having a plurality of pattern portions thereof extending in a plurality of different path directions; and an antenna disposed on the main path pattern, the antenna having opposite ends protruding from opposite ends of the connector body and connected to the connectors of the two boards.

6. The antenna device according to claim 5, wherein the main path pattern is formed in a longitudinal direction of the connector body.

7. The antenna device according to claim 5, wherein the main path pattern is formed across a longitudinal direction of the connector body.

8. The antenna device according to claim 5, wherein the main path pattern is wound around an outer circumferential portion of the connector body along a longitudinal direction of the connector body.

9. The antenna device according to claim 5, wherein each of the plurality of boards has a sub-path pattern, which connects the connector to the main path pattern, and on which a portion of the antenna protruding from the connector body is disposed, and wherein the sub-path pattern is formed along a path, with a plurality of pattern portions of the sub-path pattern extending in a plurality of different path directions.

10. The antenna device according to claim 5, wherein one of the plurality of boards has a receiver, which receives voice information, and an antenna output terminal electrically connected to the receiver, wherein the antenna output terminal has a predetermined length of signal line, which sends out the voice information, and wherein a predetermined length of antenna is provided inside the signal line.

11. The antenna device according to claim 5, wherein one of the plurality of boards has multiple layers of board bodies, and wherein each of the board bodies has an antenna pattern, which extends the antenna disposed on the sub-path pattern.

12. The antenna device according to claim 5, wherein the two boards of the plurality of boards each include an antenna path pattern and wherein the opposite ends of the antenna protruding from the opposite ends of the connector body are disposed on the antenna path pattern of the two boards.

13. A mobile communication device comprising:

a main body on which a first board made of a rigid material is disposed;

a sub-body on which a second board made of a flexible material is disposed, the sub-body slidably coupled to the main body;

a connector body made of a flexible material, and connecting the first and second boards;

a main path pattern formed along a path on the connector body, the main path pattern including a plurality of pattern portions thereof extending in a plurality of different path directions; and an antenna disposed on the main path pattern, the antenna having a first end connected to a first connector of the main body and a second end connected to a second connector of the sub-body, the first and second ends protruding from opposite ends of the connector body.

14. The mobile communication device according to claim 13, wherein the main path pattern is formed in a longitudinal direction of the connector body.

15. The mobile communication device according to claim 13, wherein the main path pattern is formed across a longitudinal direction of the connector body.

16. The mobile communication device according to claim 13, wherein the main path pattern is wound around an outer circumferential portion of the connector body along a longitudinal direction of the connector body.

17. The mobile communication device according to claim 13, wherein each of the boards has a sub-path pattern, which connects the connector to the main path pattern, and on which a portion of the antenna protruding from the connector boy is disposed, and wherein the sub-path pattern is formed along one path with a plurality of pattern portions of the sub-path pattern extending in a plurality of different path directions.

18. The mobile communication device according to claim 13, wherein one of the boards has a receiver, which receives voice information, and an antenna output terminal electrically connected to the receiver, wherein the antenna output terminal has a predetermined length of a signal line, which sends out the voice information, and wherein a predetermined length of antenna is provided inside the signal line.

19. The mobile communication device according to claim 13, wherein the second board has multiple layers of board bodies, and wherein each of the board bodies has an antenna pattern, which extends the antenna disposed on the sub-path pattern.

20. The mobile communication device according to claim 13, wherein the first board includes a first path pattern and the second board includes a second path pattern and wherein the first end of the antenna protrudes from a first end of the connector body and is disposed on the first path pattern and the second end of the antenna protrudes from a second end of the connector body and is disposed on the second path pattern.

* * * * *